US006289188B1

(12) United States Patent
Litman et al.

(10) Patent No.: US 6,289,188 B1
(45) Date of Patent: Sep. 11, 2001

(54) NON-LEAKING AND EASILY REMANUFACTURED TONER CARTRIDGE

(75) Inventors: Alan M. Litman; Anthony M. Vigliotti, both of Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/733,261

(22) Filed: Dec. 11, 2000

(51) Int. Cl.[7] ..... G03G 15/00
(52) U.S. Cl. ..... 399/109
(58) Field of Search ..... 399/109, 111, 399/113, 119, 252, 258, 262; 156/73.1, 94, 275.3; 29/402.07, 458; 222/DIG. 1

(56) References Cited

U.S. PATENT DOCUMENTS 5,183,523 * 2/1993 Rinehart et al. ..... 156/367
5,689,772 * 11/1997 Fujiwara et al. ..... 399/106
6,029,031 * 2/2000 Yokomori et al. ..... 399/109
6,141,513 * 10/2000 Nishiuwatoko et al. ..... 399/109

FOREIGN PATENT DOCUMENTS 01-209465 * 8/1989 (JP) .
04-293066 * 10/1992 (JP) .
06-156487 * 6/1994 (JP) .

* cited by examiner

*Primary Examiner*—Robert Beatty
(74) *Attorney, Agent, or Firm*—Tarlan I. Nguti

(57) ABSTRACT

A non-leaking and easily remanufactured toner cartridge is provided and includes a cartridge housing defining a first housing portion having a sump for storing toner, and a second housing portion containing development components. The first housing portion and the second housing portion each have mateable rims. The non-leaking and easily remanufactured toner cartridge also includes an externally identifiable ultrasonically meltable adhesive layer interleaved between the mateable rims of the first housing portion and the second housing portion, and an ultrasonic weld, formed by ultrasonically welding only the ultrasonically meltable adhesive layer, for bonding the mateable rims of the first housing portion and the second housing portion, thereby resulting in a non-leaking and easily remanufactured toner cartridge.

15 Claims, 4 Drawing Sheets

NON-LEAKING AND EASILY REMANUFACTURED TONER CARTRIDGE

BACKGROUND OF THE INVENTION

The present invention relates to electrostatographic reproduction machines, and more particularly to a non-leaking and easily remanufactured toner cartridge for use in such a machine.

In the well-known process of electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced.

The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In a printer, as the toner within the developer material is transferred to the photoreceptor and eventually to the copy paper, this used toner must be replaced. The printer thus includes a container or cartridge from which fresh toner is dispensed into the machine. To provide for a small, compact cartridge and to provide for a cartridge in which the cartridge may be easily removed, the cartridge typically has a compact shape.

Service costs represent a significant portion of the cost associated with operating a reproduction machine. Certain components represent those most likely to require service. By providing a method of easily replacing those certain components, the operator may replace those components himself, avoiding service technician labor costs.

These certain components are consolidated within a housing that may be easily replaced by the customer. This housing is typically called a customer replaceable unit (CRU). Typically included in a CRU are toner, a cleaning blade, the charging device (a corotron or a bias charge roll), and the photoreceptor.

A CRU is changed several times during the life of a copy machine. While a few of the components within a CRU are consumed during the life of the CRU many of the components may be reused. Therefore, the CRU is now being frequently remanufactured rather than being replaced. The remanufacturing includes refilling the CRU with new toner and inspecting all components that wear. Worn components are replaced.

The CRU must be shipped to the customer in a sealed condition. The customer must break this seal to permit toner to leave the CRU. The broken seal is removed from a used CRU housing during remanufacture. An identical seal is then placed where the original seal was located. Removing the broken seal is very difficult. The adhesive required to secure the original seal is difficult to remove from the housing. This original adhesive must be scraped from the housing, without damaging the housing so that a new housing seal will not leak.

U.S. Pat. No. 5,404,212 discloses a technique for providing an easy to remove leak-proof seal for shipment of a remanufactured toner cartridge. An adhesive-backed sealing strip is disposed over the feed roller of the hopper so that a seal is formed between the Mylar blades and the feed roller. The excess portion of the sealing strip is then passed through a foam feed roller and the lid is then sealed onto the hopper prior to shipment.

U.S. Pat. No. 4,816,877 discloses a method of refilling a toner cartridge. The cartridge has an upper portion with an upper chamber for clean toner and a lower portion with a lower chamber for used toner. The lower portion has a discharge hole opening into the lower chamber. Refilling is accomplished by piercing a hot iron rod into the plastic portion of the upper portion until a refill hole is formed. Toner is then added through this refill hole.

Toner leakage has been found to be a consistent problem with such remanufactured development apparatus cartridges. Typically, during a remanufacturing process for such cartridges, the cartridge housing is physically separated into two portions, such as so as to be able to add fresh toner and a pull strip. The two portions are later rejoined conventionally with rails or clips. During subsequent handling and use, it has been found that the fresh toner added tends to leak from the "joined" areas.

SUMMARY OF THE INVENTION

In accordance with the present invention, there is provided a non-leaking and easily remanufactured toner cartridge that includes a cartridge housing defining a first housing portion having a sump for storing toner, and a second housing portion containing development components. The first housing portion and the second housing portion each have mateable rims. The non-leaking and easily remanufactured toner cartridge also includes an ultrasonically meltable adhesive layer interleaved between the mateable rims of the first housing portion and the second housing portion, and an ultrasonic weld, formed by ultrasonically welding only the ultrasonically meltable adhesive layer, for bonding the mateable rims of the first housing portion and the second housing portion, thereby resulting in a non-leaking and easily remanufactured toner cartridge.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
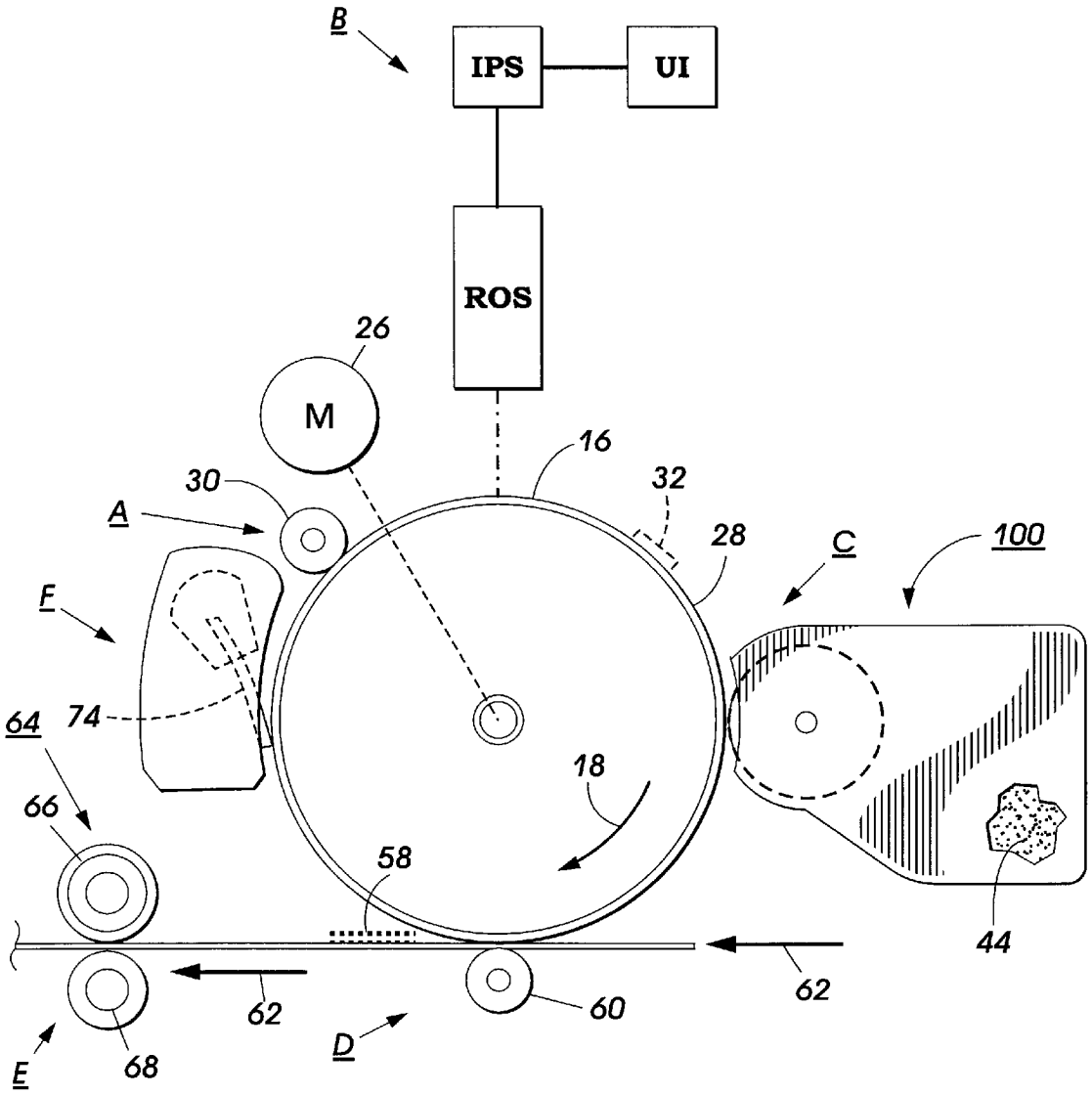
FIG. 1 is a schematic elevational illustration of an electrostatographic reproduction machine incorporating the non-leaking and easily remanufactured toner cartridge of the present invention.
Figure 2:
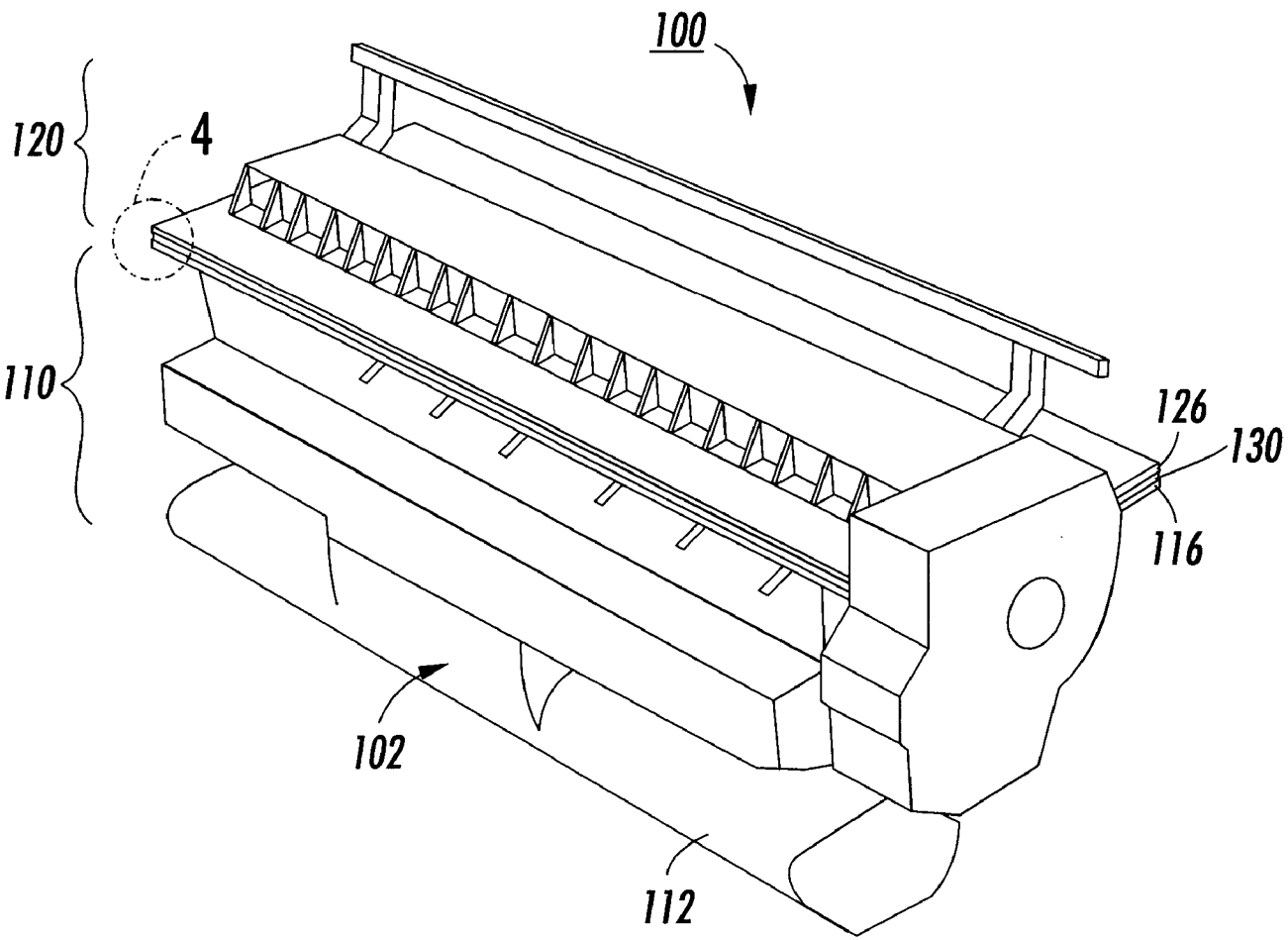
FIG. 2 is an external view showing the detectable ultrasonic weld of the non-leaking and easily remanufactured toner cartridge of the present invention.
Figure 3:
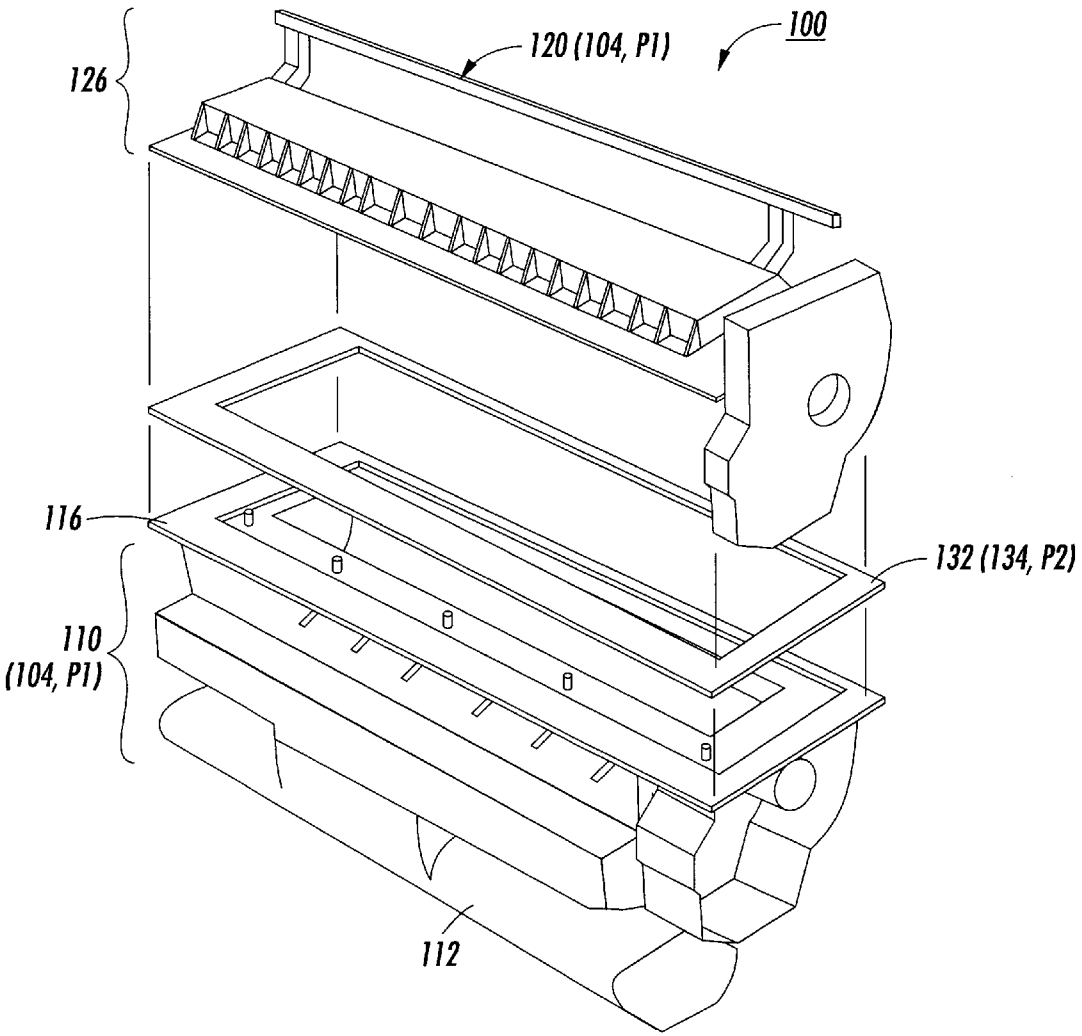
FIG. 3 is an exploded view of the non-leaking and easily remanufactured toner cartridge of the present invention.
Figure 4:
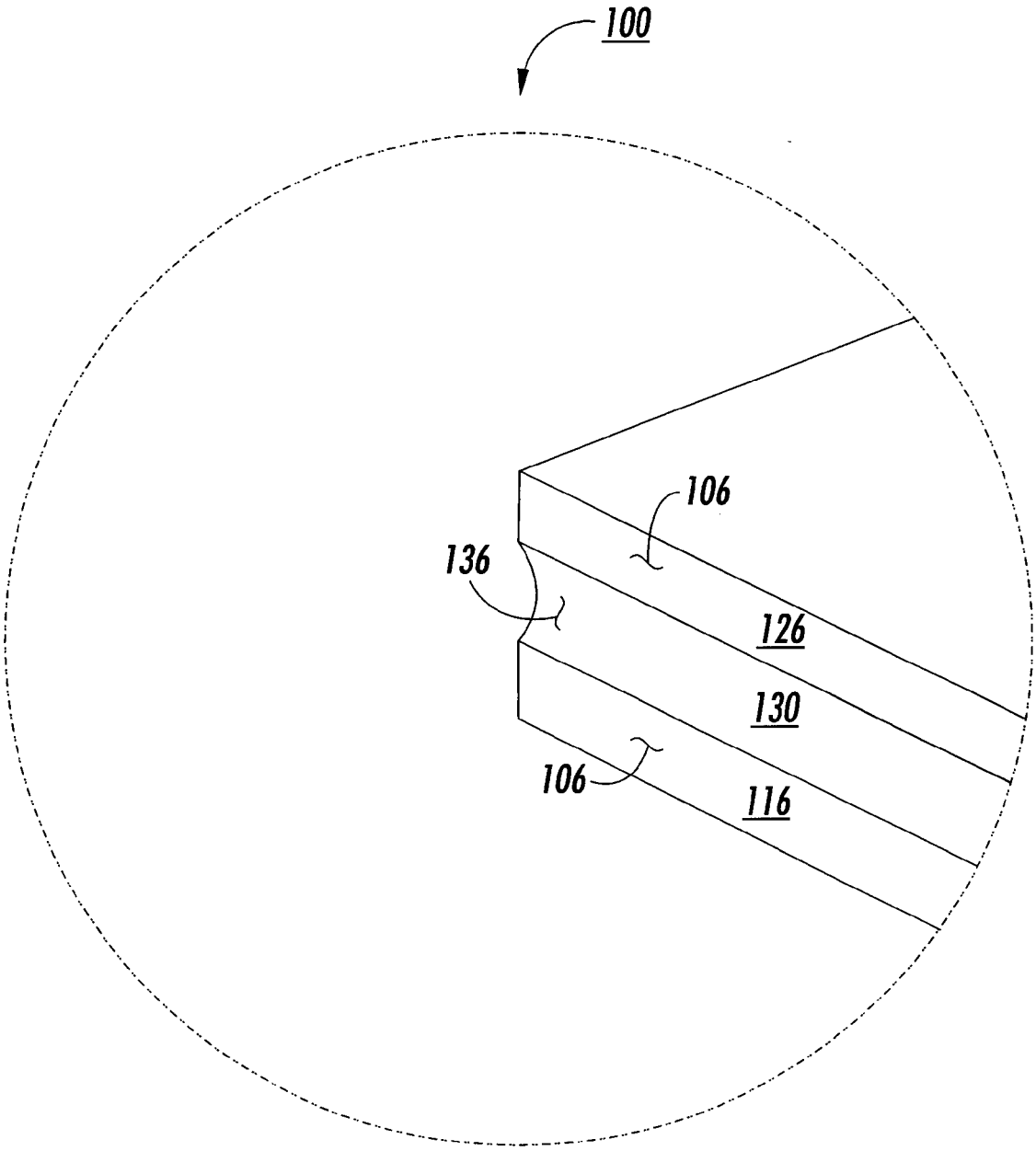
FIG. 4 (from FIG. 2) is an enlarged illustration of the detectable weld of the detectable ultrasonic weld of the non-leaking and easily remanufactured toner cartridge of the present invention.

Referring now to FIG. 1, the electrophotographic reproduction machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station AA. At charging station AA, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

Next, the charged portion of photoconductive surface 12 is advanced through exposure station BB. At exposure station BB, information that is indicative of the pages to be printed is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

At development station CC, a development apparatus comprising the non-leaking and easily remanufactured toner cartridge 100 of the present invention (to be described in detail below) is provided for advancing developer materials into contact with the electrostatic latent images on photoconductive surface 12. The non-leaking and easily remanufactured cartridge 100 includes electrically biased developer rolls and, for example, contains black developer material or toner 44 that is triboelectrically charged. As charged, the black toner develops or forms a toner image on the surface 12 by being attracted, for example, to charged areas of the latent image due to an electrostatic field existing between the photoconductive surface and the electrically biased developer rolls which are connected to a bias power supply 42.

Subsequently as shown, a sheet of support material 58 is moved into contact with the toner image on the surface 12 at transfer station DD. The sheet of support material 58 is advanced to transfer station DD by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station DD.

Transfer station DD includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station EE.

Fusing station EE includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the reproduction machine by the operator. It will also be understood that other post-fusing operations can be included, for example, binding, inverting and returning the sheet for duplexing and the like.

After the sheet of support material 58 is separated from the photoconductive surface of drum 16, the residual toner particles carried by image and the non-image areas on the photoconductive surface are removed at cleaning station FF. The cleaning station FF includes a blade 74.

Referring to FIGS. 1–4, the non-leaking and easily remanufactured cartridge 100 of the present invention is illustrated in detail in the form of a customer replaceable unit (CRU). As shown, the non-leaking and easily remanufactured cartridge 100 includes a cartridge housing 102 defining a first housing portion 110 having a sump 112 for storing toner, and a second housing portion 120 containing development components such as a photoconductor in the form of a drum, a charging device in the form of a bias charge roll, and a cleaning blade (as is well known and hence not labeled). The first housing portion 110 and the second housing portion 120 are preferably made of a first plastic material 104 that has a desired first melting point P1.

As initially manufactured or subsequently sawed off into such portions 110, 120, the housing portions 110, 120 have roughly but not precisely mateable rims 116, 126, particularly when such rims are formed by sawing during remanufacture, and even worse yet if the two portions 110 and 120 after such sawing got mixed up, and thus do not come from a single sawed cartridge.

Importantly in accordance with the present invention, the non-leaking and easily remanufactured cartridge 100 includes an ultrasonically meltable adhesive layer 130 that is interleaved between the mateable rims 116, 126 of the first housing portion 110 and the second housing portion 120 before the housing portions 110,120 are ultrasonically welded together. Such ultrasonic welding causes the ultrasonically meltable adhesive layer 130 to melt and bond to each of the rims 116, 126 of the housing portions 110, 120 respectively. The ultrasonically meltable adhesive layer 130 which is formed preferably from a die cut sheet 132, is made from a second type of plastic material 134 that has a desired second melting P2 that is significantly lower than the desired first melting point P1 of the plastic material of the housing portions 110, 120. This is important so as to enable and allow only the ultrasonically meltable adhesive layer 130 to melt first at some point during an ultrasonic welding process for bonding the house portions 110, 120 and the ultrasonically meltable adhesive layer 130. In order to facilitate remanufacture, the non-leaking and easily remanufactured cartridge 100 (after ultrasonic welding of the housing portions 110,120 and the meltable adhesive layer 130) includes an externally identifiable or detectable ultrasonic weld 136 that during remanufacture defines a path along which to saw the welded cartridge housing 102 into the housing portions 110, 120. In order to make the ultrasonic weld 136 detectable or identifiable as above, the sheet 132 of the second plastic material 134 (from which the meltable adhesive layer 130 is made), preferably has a different color from a color of the housing portions 110, 120, and/or the ultrasonic weld 136 is formed to significantly protrude beyond or preferably recessed (FIG. 4) relative to, a general surface 106 of rims 116, 126 of the welded housing portions 110, 120. In any case, the result is a non-leaking and easily remanufactured toner cartridge 100.

The second plastic material 134 of the ultrasonically meltable adhesive layer 130 can be made from a thermosetting plastic material. Preferably however, the ultrasonically meltable adhesive layer 130 is made of a thermoplastic material so that and the ultrasonic weld of the thermoplastic material is reversible by ultrasonically heating and remelting the thermoplastic material between the first housing portion and the second housing portion, thereby making the non-leaking toner cartridge easily remanufactureable.

Specifically as mentioned above, the adhesive sheet 132 which is distinguishably marked or colored, preferably is die cut to the required shape of the mateable rims 116, 126, placed on either of the rims 116, 126, fixtured together, ultrasonically heated, and allowed to cure, thereby bonding and ultrasonically welding the plastic housing portions 110, 120. The ultrasonic welding process would melt only the distinguishably marked adhesive sheet with a relatively lower melting point P2, and not the first plastic material 104 of the housing portions 110, 120. As a result, the location or position of the ultrasonic weld 136 on a finished cartridge, because of its protrusion or the distinguishing marking of the ultrasonically welded adhesive sheet 132, is still clearly identifiable or detectable.

Although both thermoplastic and thermosetting adhesive sheets can be used to form the adhesive layer 130, the advantage of a thermoplastic adhesive sheet is that it will facilitate a remanufacturing or "disassembly" operation by similarly reversing the ultrasonic process. Accordingly, to reverse, the distinguishably marked, and welded adhesive sheet layer 130 bonding the cartridge halves or two plastic housing portions 110, 120 of the cartridge, will be ultrasonically heated and remelted, thus enabling the cartridge halves or two plastic housing portions to be easily reseparated or taken apart for remanufacture, that is, for refill and rewelding.

As described previously, the cartridge halves or housing portions 110, 120 must be physically separated in order to gain access to the toner fill cap and to install the toner pull strip. Typically, the sawing of these two halves removes material from both halves, which in certain cartridge designs decreases critical dimensions needed between the two halves. The standard ultrasonic weld process inherently consumes additional material, this may lead to cartridge functionality issues when coupled with the losses from the sawing or splitting process.

In accordance with the present invention such material losses are reduced due to the use of the meltable sheet 132 and the ultrasonic welding process. If needed, an additional die-cut spacer and sheet adhesive material can be used to re-capture the material losses from both the splitting and welding process.

As also pointed out above, a typical sawing or splitting operation (like all sawing procedures) results in slight deformation of the working surfaces or mateable rims 116, 126. After such splitting, the two resulting halves or housing portions 110, 120 are thus "partners" for the remainder of the remanufacturing process because they share common surface abnormalities. If however, two uncommon halves are conventionally assembled by clips or glue, leaking is more likely to occur due to gaps left by two opposing valleys. In accordance with the present invention, the use of the meltable/weldable adhesive sheet 132 has been found to enable and allow first housing portions 110 and second housing portions 120 to be randomly mated regardless of whether they were "partners" or not. This is because the welded adhesive sheet 132 effectively fills all peaks and valleys, resulting in a perfect and strong hermetic seal.

As can be seen, there has been provided a non-leaking and easily remanufactured toner cartridge that includes a cartridge housing defining a first housing portion having a sump for storing toner, and a second housing portion containing development components. The first housing portion and the second housing portion each have mateable rims. The non-leaking and easily remanufactured toner cartridge also includes an ultrasonically meltable adhesive layer interleaved between the mateable rims of the first housing portion and the second housing portion, and an ultrasonic weld, formed by ultrasonically welding only the ultrasonically meltable adhesive layer, for bonding the mateable rims of the first housing portion and the second housing portion, thereby resulting in a non-leaking and easily remanufactured toner cartridge.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A non-leaking and easily remanufactured toner cartridge comprising:

(a) a cartridge housing defining a first housing portion including a sump for storing toner, and a second housing portion containing development components, said first housing portion and said second housing portion having mateable rims;

(b) an ultrasonically meltable adhesive layer interleaved between said mateable rims of said first housing portion and said second housing portion; and (c) an externally identifiable ultrasonic weld for defining a path along which to cut said cartridge housing for remanufacturing, said externally identifiable ultrasonic weld being formed by ultrasonically welding only said ultrasonically meltable adhesive layer, for bonding said mateable rims of said first housing portion and said second housing portion, thereby resulting in a non-leaking and easily remanufactured toner cartridge.

2. The non-leaking and easily remanufactured toner cartridge of claim 1, wherein said cartridge housing is made of a plastic material having a first melting point.

3. The non-leaking and easily remanufactured toner cartridge of claim 1, wherein said ultrasonically meltable adhesive layer is made of a thermoplastic material.

4. The non-leaking and easily remanufactured toner cartridge of claim 1, wherein said ultrasonically meltable adhesive layer is made of a thermosetting plastic material.

5. The non-leaking and easily remanufactured toner cartridge of claim 1, wherein said ultrasonically meltable adhesive layer is made of a thermoplastic material and said ultrasonic weld of said thermoplastic material is reversible by ultrasonically heating and remelting said thermoplastic material between said first housing portion and said second housing portion, thereby making the non-leaking toner cartridge easily remanufactureable.

6. The non-leaking and easily remanufactured toner cartridge of claim 3, wherein said ultrasonically meltable adhesive layer material is formed from a sheet material.

7. The non-leaking and easily remanufactured toner cartridge of claim 3, wherein said ultrasonically meltable adhesive layer is formed from a sheet material having a second melting point lower than said first melting of said plastic material.

8. An electrostatographic reproduction machine comprising:

(a) a movable photoconductive member having an image bearing surface;

(b) means for forming a latent image electrostatically on said image bearing surface; and (c) a development apparatus comprising a non-leaking and easily remanufactured toner cartridge including:

(i) a cartridge housing defining a first housing portion having a sump for storing toner, and a second housing portion containing development components, said first housing portion and said second housing portion having mateable rims;

(ii) an ultrasonically meltable adhesive layer interleaved between said mateable rims of said first housing portion and said second housing portion; and (iii) an externally identifiable ultrasonic weld for defining a path along which to cut said cartridge housing for remanufacturing, said externally identifiable ultrasonic weld being formed by ultrasonically welding only said ultrasonically meltable adhesive layer, for bonding said mateable rims of said first housing portion and said second housing portion, thereby resulting in a non-leaking and easily remanufactured toner cartridge.

9. The electrostatographic reproduction machine of claim 8, wherein said cartridge housing is made of a plastic material having a first melting point.

10. The electrostatographic reproduction machine of claim 8, wherein said ultrasonically meltable adhesive layer is made of a thermoplastic material.

11. The electrostatographic reproduction machine of claim 8, wherein said ultrasonically meltable adhesive layer is made of a thermosetting plastic material.

12. The electrostatographic reproduction machine of claim 8, wherein said ultrasonically meltable adhesive layer is made of a thermoplastic material and said ultrasonic weld of said thermoplastic material is reversible by ultrasonically heating and remelting said thermoplastic material between said first housing portion and said second housing portion, thereby making the non-leaking toner cartridge easily remanufactureable.

13. The electrostatographic reproduction machine of claim 10, wherein said ultrasonically meltable adhesive layer material is formed from a sheet material.

14. The electrostatographic reproduction machine of claim 10, wherein said ultrasonically meltable adhesive layer is formed from a sheet material having a second melting point lower than said first melting of said plastic material.

15. The non-leaking and easily remanufactured toner cartridge of claim 1, wherein said ultrasonically meltable adhesive layer has a color different from a color of said first housing portion and of said second housing portion.

* * * * *